US006761577B1

(12) United States Patent
Koehler

(10) Patent No.: US 6,761,577 B1
(45) Date of Patent: Jul. 13, 2004

(54) MATING DETECTION SYSTEM FOR AN ELECTRICAL CONNECTOR ASSEMBLY

(75) Inventor: David F. Koehler, Lake Orion, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/337,162

(22) Filed: Jan. 6, 2003

(51) Int. Cl.[7] ..... H01R 3/00
(52) U.S. Cl. ..... 439/489
(58) Field of Search ..... 439/489, 488, 439/577; 116/274, 283, DIG. 28

(56) References Cited

U.S. PATENT DOCUMENTS 3,113,553 A * 12/1963 Schinske ..... 439/489
5,562,485 A * 10/1996 Hoyte et al. ..... 439/489
5,820,405 A * 10/1998 Yagi et al. ..... 439/489
6,077,104 A * 6/2000 Chang et al. ..... 439/489

* cited by examiner

*Primary Examiner*—Renee Luebke
(74) *Attorney, Agent, or Firm*—Stacey E. Caldwell

(57) ABSTRACT

A mating detection system is provided in an electrical connector assembly. A first connector has a mating detection element integral therewith and movable from an unmated position to a mating detection position. A second connector is mateable with the first connector and has an actuator element engageable with the mating detection element of the first connector. The actuator element moves the mating detection element from its unmated position to its mating detection position and, thereby, visually indicates that the connectors have been mated.

15 Claims, 3 Drawing Sheets

MATING DETECTION SYSTEM FOR AN ELECTRICAL CONNECTOR ASSEMBLY

FIELD OF THE INVENTION

This invention generally relates to the art of electrical connectors and, particularly, to a system for detecting whether or not a pair of connectors have been mated.

BACKGROUND OF THE INVENTION

Generally, an electrical connector assembly includes a pair of connectors which are mated at a connector interface. For instance, a plug or male connector may be mateable with a receptacle or female connector. Typically, each connector includes some form of dielectric housing mounting a plurality of conductive terminals which interengage to establish electrical continuity through the assembly when the connectors are mated.

In some applications, it may be desirable to be able to detect whether or not a pair of connectors are fully mated. Such detection systems have some form of indicator which is in a given position when the connectors are fully mated. However, there are other applications wherein it may be desirable to indicate whether or not a pair of connectors have ever been mated, even after the connectors are separated. For instance, in the automotive industry, when a consumer returns a vehicle to a dealership for service because of certain components not operating properly or because warning lights become visible, the dealership attempts to determine the root cause of the problem. One such root cause is the fact that a pair of electrical connectors have not been fully mated. In certain areas of the vehicle, this is quite difficult to determine. The present invention is direction to providing a mating detection system in an electrical connector assembly which can detect whether or not a pair of connectors have ever been fully mated in a first instance, even when the connectors are separated or unmated.

SUMMARY OF THE INVENTION

An object, therefore, of the invention is to provide a new and improved mating detection system in an electrical connector assembly.

In the exemplary embodiment of the invention, a first connector includes a mating detection element integral therewith and movable from an unmated position to a mating detection position. A second connector is mateable with the first connector and has an actuator element engageable with the mating detection element of the first connector to move the detection element from its unmated position to its mating detection position and, thereby, visually indicate that the connectors have been mated.

According to one aspect of the invention, the mating detection element is fabricated of deformable material and is deformed when moving from its unmated position to its mating detection position. The mating detection element may be fabricated of plastic, metal or like deform able material. As disclosed herein, the detection element is formed by an engaging button connected to a housing of the first connector by at least one deformable web. The actuator element on the second connector is provided by a protruding boss.

According to another aspect of the invention, the first connector includes a housing panel having an opening with a peripheral edge. The engaging button which forms the mating detection element is located within the opening and is joined to the peripheral edge thereof by a plurality of deformable webs in a spoke-like arrangement. The panel has a front mating side, and the spoke-like deformable webs project forwardly therefrom to locate the engaging button spaced forwardly of the front mating side of the panel in the unmated position of the button. The webs are deformed and the engaging button "snaps" through the opening to a rear side of the panel in the mating detection position of the button.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
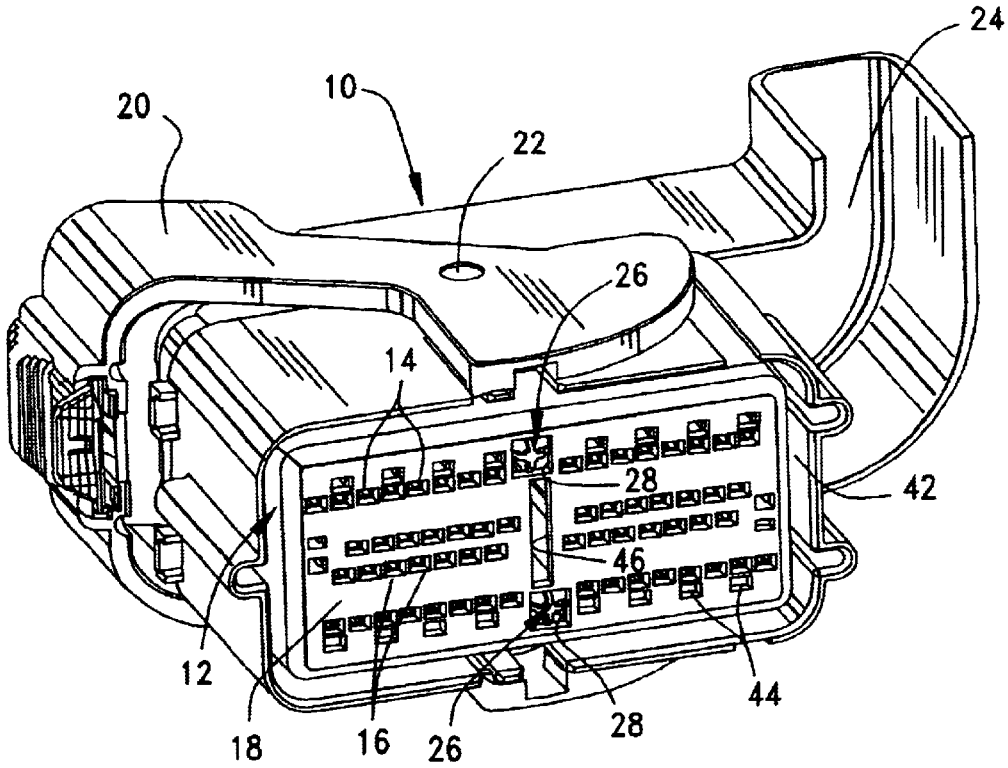
FIG. 1 is a perspective view looking at the mating end of a first electrical connector having a pair of the mating detection elements according to the invention, with the detection elements in their unmated positions.
Figure 2:
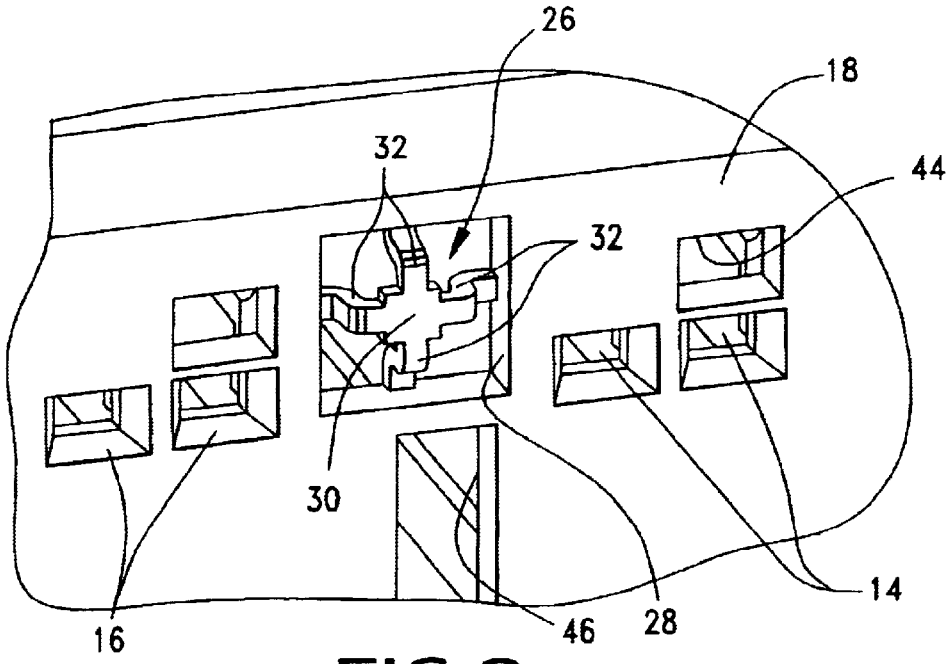
FIG. 2 is an enlarged perspective view a portion of the mating end of the connector in FIG. 1, showing an enlarged depiction of one of the mating detection elements in its unmated position.
Figure 3:
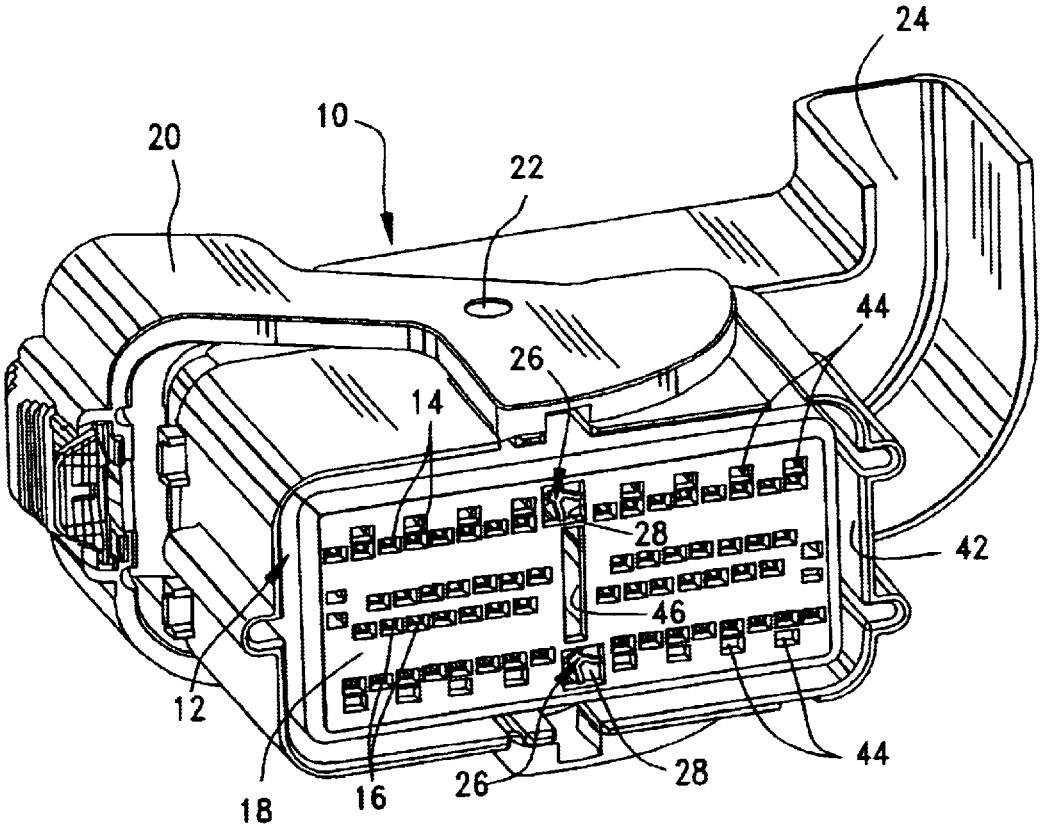
FIG. 3 is a view similar to that of FIG. 1, with the mating detection elements in their mating detection positions.
Figure 4:
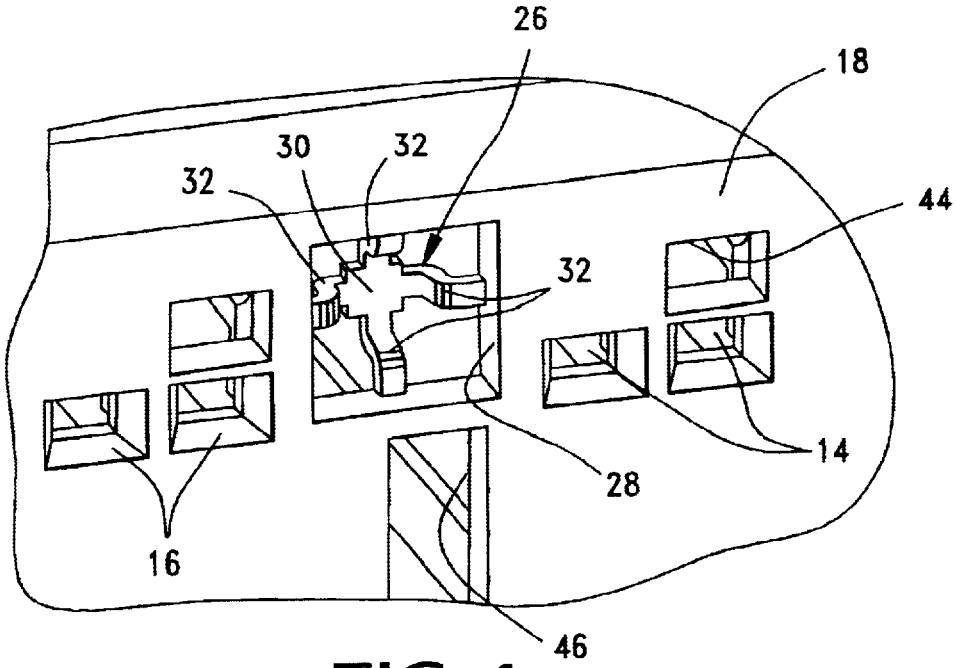
FIG. 4 is a view similar to that of FIG. 2, with the mating detection element in its mating detection position.

Referring to the drawings in greater detail, FIGS. 1 and 2 show the mating detection elements of the invention in their unmated positions. FIGS. 3 and 4 show the mating detection elements in their mating detection positions.

More particularly, FIG. 1 shows a first electrical connector, generally designated 10, which includes a dielectric housing, generally designated 12, mounting a plurality of conductive female terminals 14 within a plurality of terminal-receiving passages 16 which are open at a front mating face or side 18 of the connector. Connector 10 is but one of many connector configurations with which the invention is applicable. Suffice it to say, connector 10 includes a lever arm 20 pivoted at 22 and engageable with a complementary mating connector (described hereinafter in relation to FIG. 5) for drawing the mating connector into mating engagement with connector 10. A shroud 24 receives a plurality of electrical wires (not shown) which are attached to terminals 14.

Figure 5:
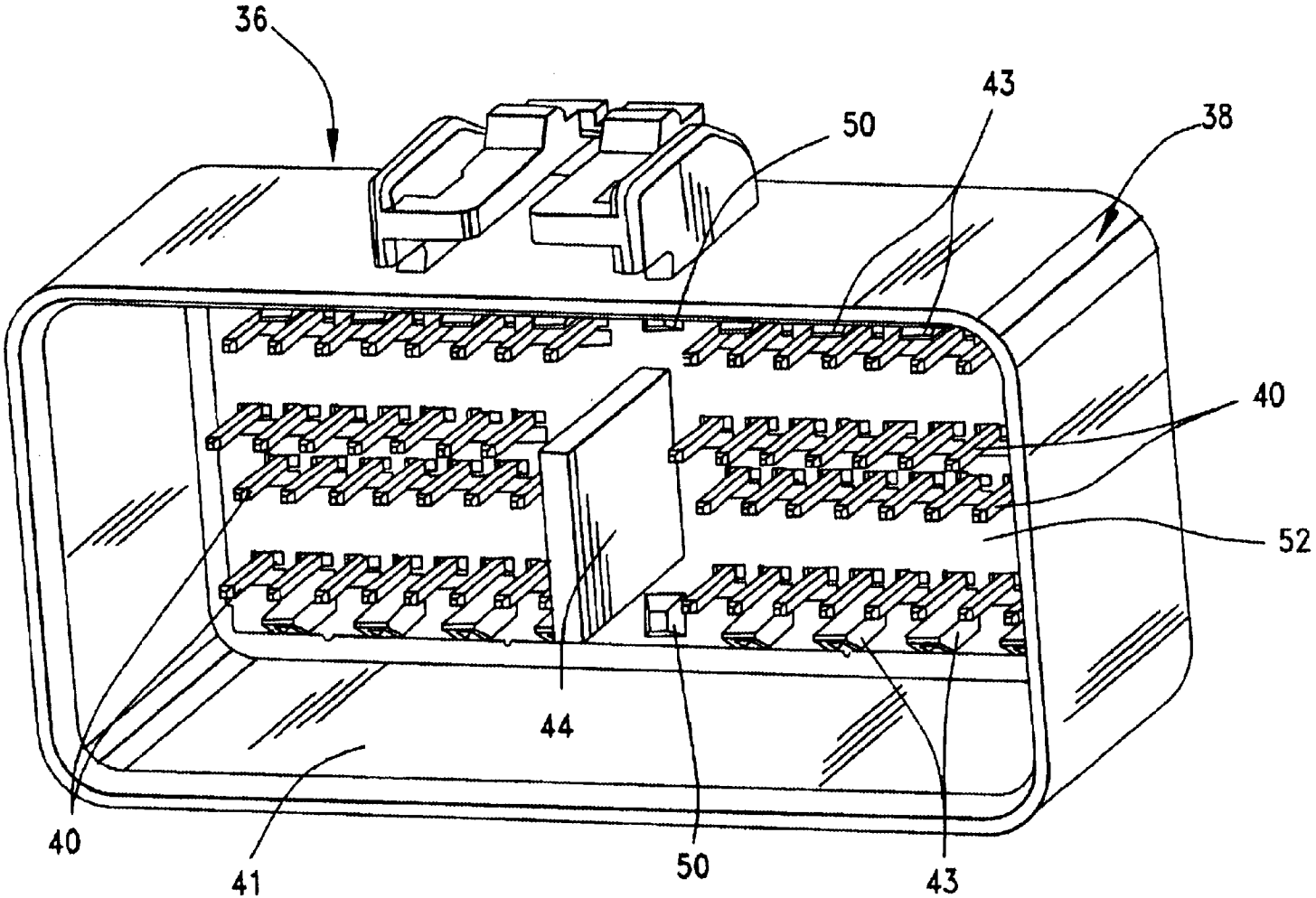
FIG. 5 is a perspective view of the mating end of a second connector which is mateable with the connector of FIGS. 1–4, and including a pair of actuator elements according to the invention.

Generally, the invention is directed to a mating detection system to visually indicate or detect whether or not connector 10 has been mated with the complementary mating connector (FIG. 5). Specifically, a pair of mating detection elements, generally designated 26, are provided at front mating face 18 of the connector. As seen best in FIG. 2, the front mating face of the connector is in the form of a panel having an opening 28 within which each mating detection element 26 is disposed.

Referring specifically to FIG. 2, each mating detection element 26 includes an engaging button 30 located within opening 28 and joined to the peripheral edge of the opening by a plurality of deformable webs 32 in a spoke-like arrangement. In other words, deformable webs 32 are integral between engaging button 30 and the peripheral edge of opening 28. Although the invention can be employed in a structure fabricated of metal material, mating face 18, engaging button 30 and deformable webs 32 all can be molded of plastic material, whereby the deformable webs have resilient characteristics and repeatable cycles, as described hereinafter.

FIG. 2 also shows that deformable webs 32 project forwardly from mating face 18 to locate engaging button 30 spaced forwardly of the front mating face. This defines the unmated position of the button(s) as shown in both FIGS. 1 and 2.

FIGS. 3 and 4 show engaging buttons 30 of mating detection elements 26 having been pushed inwardly relative to front mating face 18. In other words, the engaging buttons now are disposed behind the panel which defines front mating face 18, inwardly of openings 28. It can be seen quite clearly in FIG. 4 that deformable webs 32 have now been deformed and extend inwardly of opening 28 rather than outwardly as shown in FIG. 2. The position of the mating detection elements 26 and engaging buttons 30 in FIGS. 3 and 4 define the mating detection positions of the elements or buttons. In other words, an operator can look at the inwardly moved engaging buttons (as seen in FIG. 4) and readily observe that the buttons have been moved to their mating detection positions which visually indicates that the connectors have been mated.

In operation, deformable webs 32 define sort of an "overcenter" arrangement or connection means whereby engaging buttons 30 "snap" through opening 28 from their forward unmated positions (FIGS. 1 and 2) to their rearward mating detection positions (FIGS. 3 and 4).

With the overcenter snapping action provided for engaging buttons 30 by deformable webs 32, once an operator has determined that connector 10 has been mated at least once (i.e., engaging buttons 30 are in the mating detection positions of FIGS. 3 and 4), the operator can use an appropriate hooked tool to pull engaging buttons 30 back outwardly to their unmated positions of FIGS. 1 and 2. Connector 10 then is "reset" so that it again can be determined whether or not the connector has been mated with the complementary mating connector at least one time. With the mating detection elements fabricated of plastic material, the mating detection elements can be moved and reset numerous times.

FIG. 5 shows a second or complementary mating electrical connector, generally designated 36, which is mateable with connector 10 (FIGS. 1–4). Mating connector 36 includes a housing, generally designated 38, which mounts a plurality of conductive terminal pins 40 which are insertable into passages 16 and into engagement with terminals 14 of connector 10. A shroud 41 of connector 36 is insertable into a peripheral groove 42 in front mating face 18 of connector 10. Again, connector 36 can take a wide variety of configurations while incorporating the concepts of the invention. For instance, connector 10 includes a plurality of probes 43 which are insertable into a plurality of holes 44 (FIG. 1) in front mating face 18 of connector 10 for engaging shorting bars within connector 10. Mating connector 36 includes a plate 44 which projects forwardly therefrom to protect terminal pins 40. Plate 44 is insertable into a slot 46 (FIG. 1) in connector 10.

The invention contemplates that the second or complementary mating connector 36, regardless of its configuration, include a pair of actuator elements 50 projecting from a mating face 52 of the connector. Actuator elements 50 are in the form of protruding bosses which are engageable with engaging buttons 30 of mating detection elements 26 of connector 10.

In operation, when mating connector 36 is mated with connector 10, mating face 52 of connector 36 generally abuts front mating face 18 of connector 10. During mating, the actuator elements formed by protruding bosses 50 on mating connector 36, engage engaging buttons 30 and move the engaging buttons from their unmated positions of FIGS. 1 and 2 to their mating detection positions of FIGS. 3 and 4. In other words, engaging buttons 30 snap through openings 28 to the mating detection position shown clearly in FIG. 4. The engaging buttons will remain in these positions notwithstanding the unmating or separation of mating connector 36 from connector 10. Therefore, an operator can readily observe that the connectors have been mated at least once. After appropriate servicing, engaging buttons 30 can be pulled back outwardly from their mating detection positions of FIGS. 3 and 4 to their unmated positions of FIGS. 1 and 2. Connector 10 now has been reset with the mating detection elements in position to indicate subsequent mating of the connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A mating detection system in an electrical connector assembly, comprising:

a first connector having a mating detection element integral therewith and movable from an unmated position to a mating detection position; and a second connector mateable with the first connector and having an actuator element engageable with the mating detection element of the first connector to move the detection element from said unmated position to said mating detection position and thereby visually indicate that the connectors have been mated, the mating detection element remaining in said mating detection position when the connectors are unmated to thereby visually indicate whether or not the connectors have ever been mated.

2. The mating detection system of claim 1 wherein said mating detection element is fabricated of deformable material and is deformed when moving from said unmated position to said mating detection position.

3. The mating detection system of claim 2 wherein said mating detection element is fabricated of plastic material.

4. The mating detection system of claim 2 wherein said mating detection element is fabricated of metal material.

5. The mating detection system of claim 2 wherein said mating detection element comprises an engaging button connected to a housing of the first connector by at least one deformable web.

6. The mating detection system of claim 1 wherein said first connector includes a panel having an opening with a peripheral edge, and the mating detection element comprises an engaging button located within the opening and joined to the peripheral edge thereof by deformable web means.

7. The mating detection system of claim 6 wherein said deformable web means comprise a plurality of deformable webs extending between the engaging button and the peripheral edge of said opening in a spoke-like arrangement.

8. The mating detection system of claim 7 wherein said panel has a front mating side and said webs project forwardly therefrom to locate the engaging button spaced forwardly of the front mating side of the panel in the unmated position of the button.

9. The mating detection system of claim 8 wherein said webs are deformable and the engaging button snaps through the opening to a rear side of the panel in the mating detection position of the button.

10. The mating detection system of claim 9 wherein said actuator element of the second connector comprises a protruding boss.

11. A mating detection system in an electrical connector assembly, comprising:

a first connector including a housing panel having an opening with a peripheral edge, an engaging button located within the opening and joined to the peripheral edge thereof by a plurality of deformable webs extending between the engaging button and the peripheral edge of the opening in a spoke-like arrangement, the deformable webs projecting forwardly from a front mating side of the housing panel to locate the engaging button spaced forwardly of the front mating side of the panel in an unmated position of the engaging button, the deformable webs being resiliently deformable whereby the engaging button can snap through the opening to a rear side of the housing panel in a mating detection position of the button; and a second connector mateable with the first connector and having an actuator element engageable with the engaging button of the first connector to move the engaging button from said unmated position to said mating detection position and thereby visually indicate that the connectors have been mated.

12. The mating detection system of claim 11 wherein said actuator element of the second connector comprises a protruding boss.

13. The mating detection system of claim 11 wherein said housing panel, engaging button and deformable webs are molded of plastic material integral with each other.

14. A mating detection system in an electrical connector assembly, comprising;

a first connector having a mating detection element integral therewith by an overcenter connection means whereby the detection element snaps from an unmated position to a mating detection position; and a second connector mateable with the first connector and having an actuator element engageable with the mating detection element of the first connector to move the detection element from said unmated position to said mating detection position and thereby visually indicate that the connectors have been mated, the mating detection element remaining in said mating detection position when the connectors are unmated to thereby visually indicate whether or not the connectors have ever been mated.

15. The mating detection system of claim 14 wherein said overcenter connection means comprises a deformable web integrally connecting the mating detection element to the first connector.

* * * * *